US007290688B2

(12) United States Patent
Pikielny

(10) Patent No.: US 7,290,688 B2
(45) Date of Patent: Nov. 6, 2007

(54) TACTICAL GEAR RECEPTACLE WITH ACCESSORIES MOUNTING RAIL

(76) Inventor: Dov Pikielny, 7 Dov Hoz Street, Herzliya (IL) 46581

( * ) Notice: Subject to any disclaimer, the term of this patent is extended or adjusted under 35 U.S.C. 154(b) by 146 days.

(21) Appl. No.: 11/109,704

(22) Filed: Apr. 20, 2005

(65) Prior Publication Data

US 2006/0236583 A1 Oct. 26, 2006

(51) Int. Cl.
*F41C 33/04* (2006.01)

(52) U.S. Cl. ..... 224/163; 224/193; 224/243

(58) Field of Classification Search ..... 102/275.12; 89/34; 224/238, 243, 244, 192, 193, 198, 224/150, 163
See application file for complete search history.

(56) References Cited

U.S. PATENT DOCUMENTS 4,921,103 A * 5/1990 Cohen ..... 206/523
4,971,236 A * 11/1990 Grummet ..... 224/243
5,107,612 A * 4/1992 Bechtel ..... 42/115
5,166,459 A 11/1992 Stahle et al.
5,562,459 A 10/1996 Durlach
5,615,506 A * 4/1997 Jackson et al. ..... 42/50
5,875,944 A * 3/1999 Beletsky ..... 224/198
6,267,279 B1 7/2001 Matthews
6,655,069 B2 * 12/2003 Kim ..... 42/114
6,698,129 B1 * 3/2004 Hanks ..... 42/90
6,886,725 B2 5/2005 Lowe et al.
2004/0068913 A1 4/2004 Solinsky et al.
2005/0205621 A1 * 9/2005 Shults ..... 224/198
2005/0224537 A1 10/2005 Rassias
2005/0268518 A1 12/2005 Pikielny

* cited by examiner

*Primary Examiner*—Stephen M Johnson
(74) *Attorney, Agent, or Firm*—Dekel Patent Ltd.; David Klein

(57) ABSTRACT

A tactical gear receptacle including a carrying apparatus affixed on a first side thereof, the carrying apparatus being adapted to support at least a partial weight of the tactical gear receptacle when the tactical gear receptacle is carried, and a light rail affixed to a second side of the tactical gear receptacle.

11 Claims, 9 Drawing Sheets

TACTICAL GEAR RECEPTACLE WITH ACCESSORIES MOUNTING RAIL

FIELD OF THE INVENTION

The present invention relates generally to tactical gear, and particularly to a tactical gear receptacle with a mounting rail for mounting thereto accessories, such as but not limited to, a weapons light, flashlight, laser device, telescopic sight, knife, multi-tool and others.

BACKGROUND OF THE INVENTION

Many weapon manufacturers today manufacture and market weapons with provisions for mounting a light on the weapon. For example, the major handgun manufacturers, such as Springfield Armory, Glock, SIG and many others, make handguns with a light mounting rail formed on the pistol/rifle frame, such as on the underside or top or both sides of the barrel. Such a mounting rail is often referred to in the art as a "light rail" (or a "Picatinny rail", or "universal rail", or "tactical rail" or "accessories rail", the terms being used interchangeably throughout the specification and claims). The light rail has been used for mounting white-lights, infrared and laser illuminating devices and telescopic sights, for example. Leading flashlight companies, such as SureFire and Insight Technology make different kinds of lights for mounting on rifles/handguns. Light rails are extensively used by the military, law enforcement SWAT teams, as well as by civilians. Light rails have been provided for a variety of weapons, such as handguns, shoulder-fired weapons, shotguns and rifles (e.g. M1A, M16, AR15 & MP5's).

A typical light rail design is described in U.S. Pat. No. 5,881,486, wherein a longitudinal rail is integrally formed on the top of the weapon casing (along the barrel portion) and on the casing extension as a mounting for a telescopic sight. The longitudinal rail has a dovetail profile on which two clamps are guided that hold the telescopic sight. The longitudinal rail has grooves in the transverse direction at specific intervals. These grooves offer space for clamping screws that fix the clamp. This allows the optical axis of the telescopic sight to be positioned very close to the barrel axis.

Most holsters are designed in such a way that one can not place a handgun in the holster without dismantling the light or other accessory from the light rail. If the light or other accessory is dismantled from the light rail, then a specific accessory is required, e.g., in order to carry the light/accessory on a belt.

SUMMARY OF THE INVENTION

The present invention seeks to provide an improved tactical gear receptacle (such as but not limited to a holster) with one or more mounting rails for accessories, such as but not limited to, a weapons light, flashlight, laser device, telescopic sight and others, as is described in detail further hereinbelow.

There is thus provided in accordance with an embodiment of the present invention apparatus including a tactical gear receptacle including a carrying apparatus affixed on a first side thereof, the carrying apparatus being adapted to support at least a partial weight of the tactical gear receptacle when the tactical gear receptacle is carried, and a light rail affixed to a second side of the tactical gear receptacle. The apparatus may include one or more of the following features. For example, the light rail may include a plurality of ridges spaced from one another along a rail axis, the ridges being separated by grooves that are transverse to the rail axis. The light rail may have male or female connectors or a combination thereof. One or more accessories may be mounted on the light rail, such as but not limited to, a non-coherent light device, a coherent light device, a telescopic sight, and/or an outdoors sport device.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Before describing embodiments of the invention, some terms will be defined. Throughout the specification and claims, the term "tactical gear" encompasses equipment that may be carried by civilians, outdoorsmen, military, SWAT (special weapons and tactics) teams, anti-terrorist squads, bomb-defusing teams, intelligence and counter-intelligence personnel, and the like, such equipment including, but not limited to, ammunition, magazines, knives, rappelling equipment (e.g., harnesses, retention lanyards, grappling hooks, ropes, etc.), climber or mountaineering equipment (e.g., carabiners, pitons, descendeurs, picks, axes, hammers, chocks, etriers, fiffi hooks, griff-fiffi hooks, etc.), GPS equipment, flashlights, compasses, multi-tools (e.g., Swiss army knife, LEATHERMAN brand multi-tools), and personal communication devices (e.g., cellular phones, walkie-talkies, pagers, radios and others).

Throughout the specification and claims, the term "receptacle" encompasses an item with sides that define a volume for placing therein an object, such as but not limited to, pouches, containers, bottles, cases, bags, duffel bags, knapsacks, backpacks, rucksacks, carriers, boxes, holsters, attache cases, briefcases, suitcases, and luggage, and the like.

The term "tactical gear receptacle" does not include barrels or other chambers of weapons through which ammunition may be fired. However, the term "tactical gear receptacle" does include other receptacles of weapons not along a path for firing a weapon, such as but not limited to, a handle, grip or magazine well of a handgun and the like.

The invention will first be described for a specific type of tactical gear receptacle, namely, a holster for an ammunition firing weapon, such as but not limited to, a handgun. The holster is a receptacle designed to hold a weapon (which may itself have a light rail) and a tactical gear item mounted on the light rail of the holster (e.g., a weapon light, as described below), wherein the tactical gear item may be transferred from the light rail of the holster to be mounted on the light rail of the weapon. This is different from other receptacles of other embodiments of the invention designed to hold a tactical gear item (e.g., a magazine pouch for holding one or more magazines) and an accessory mounted on the light rail of the receptacle (e.g., a weapon light), but wherein the tactical gear item does not have a light rail of its own, so that the accessory is not meant to be transferred from the light rail of the receptacle to be mounted on that tactical gear item (but may be mounted on some other tactical gear item, such as a gun).

Figure 1:
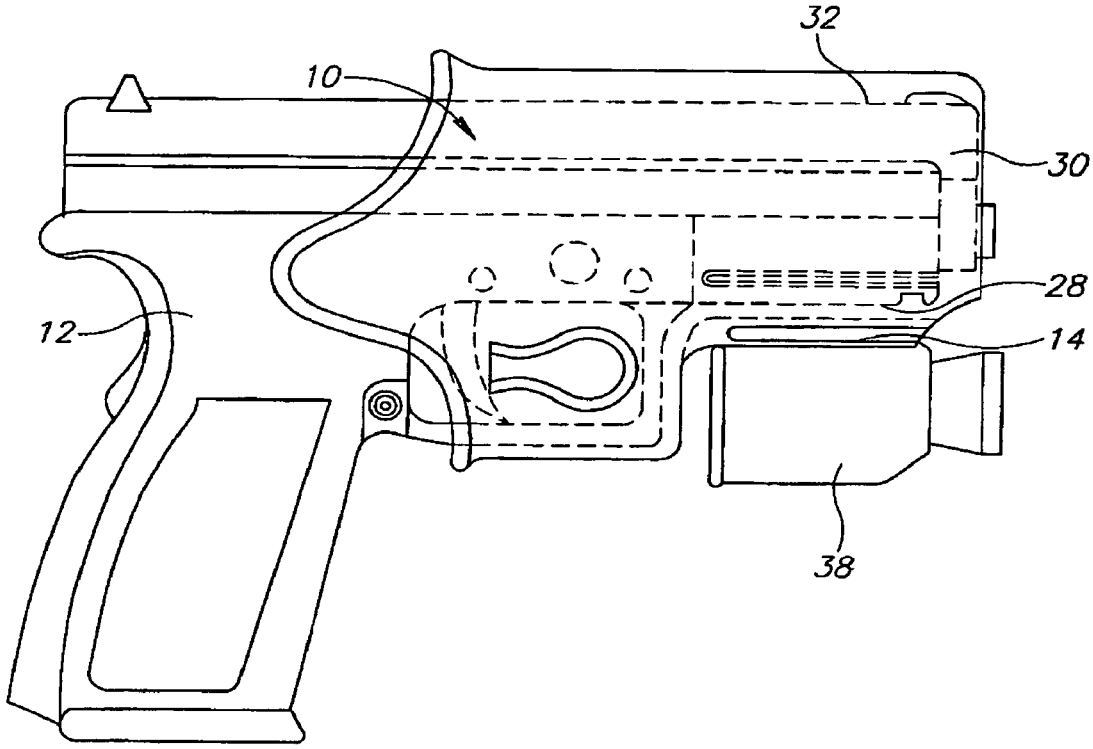
FIG. 1 is a simplified pictorial illustration of a holster with a light rail, constructed and operative in accordance with an embodiment of the present invention, with a weapon disposed in the holster and an accessory (e.g., weapon light) mounted on the light rail of the holster.
Figure 2A:
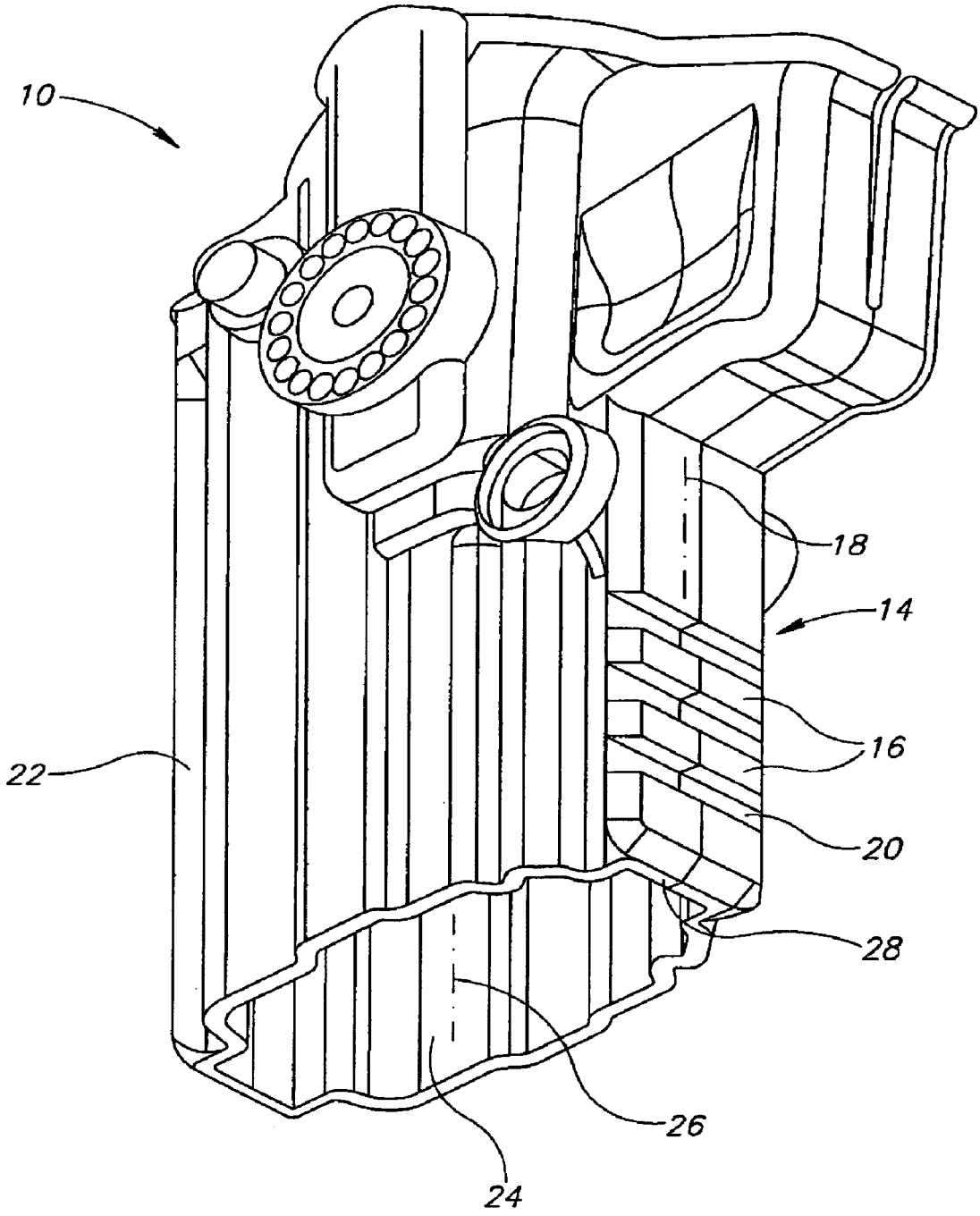
FIGS. 2A, 2B and 2C are simplified perspective, side view and bottom view illustrations, respectively, of the holster of FIG. 1.
Figure 2B:
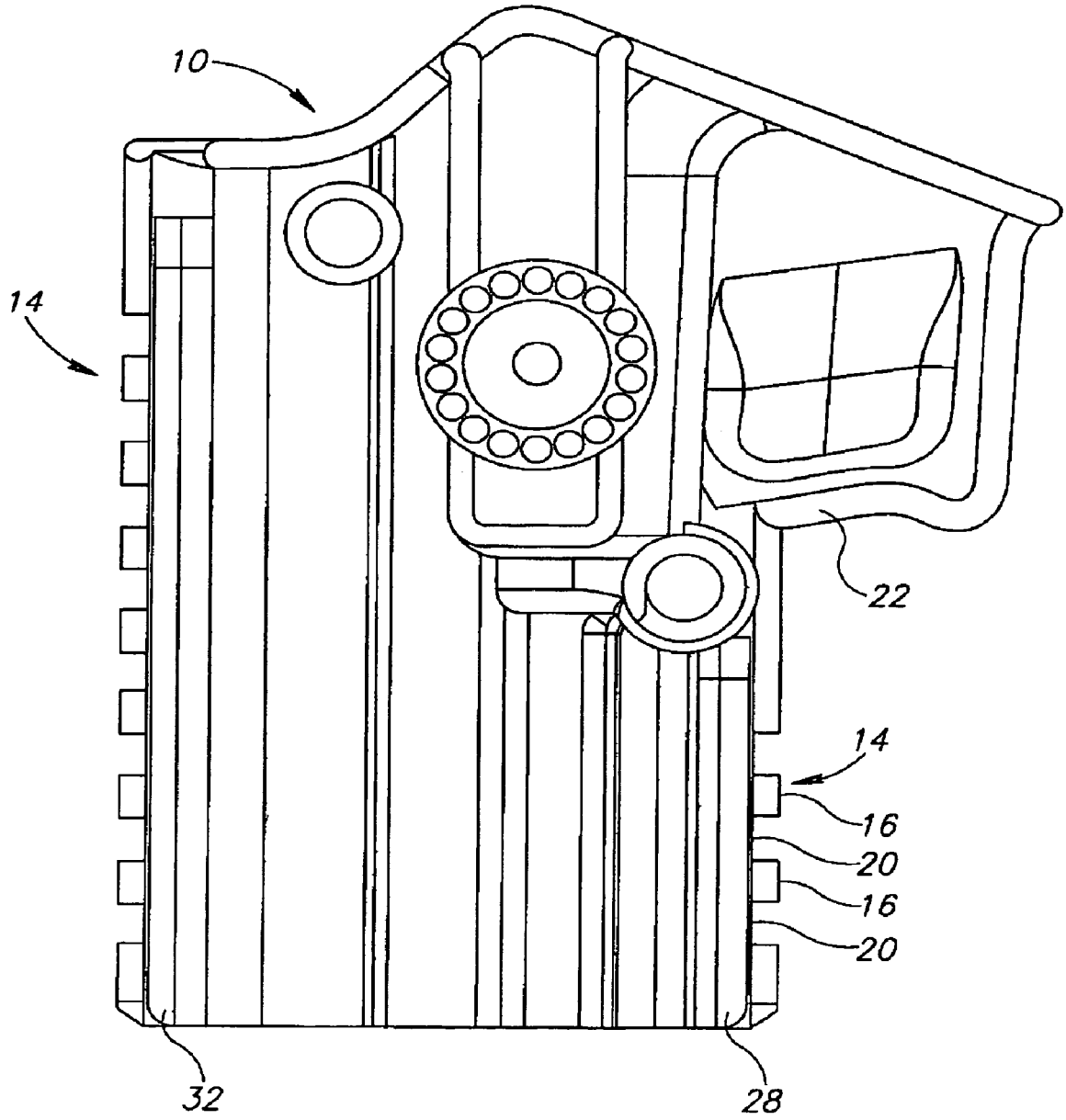
Figure 2C:
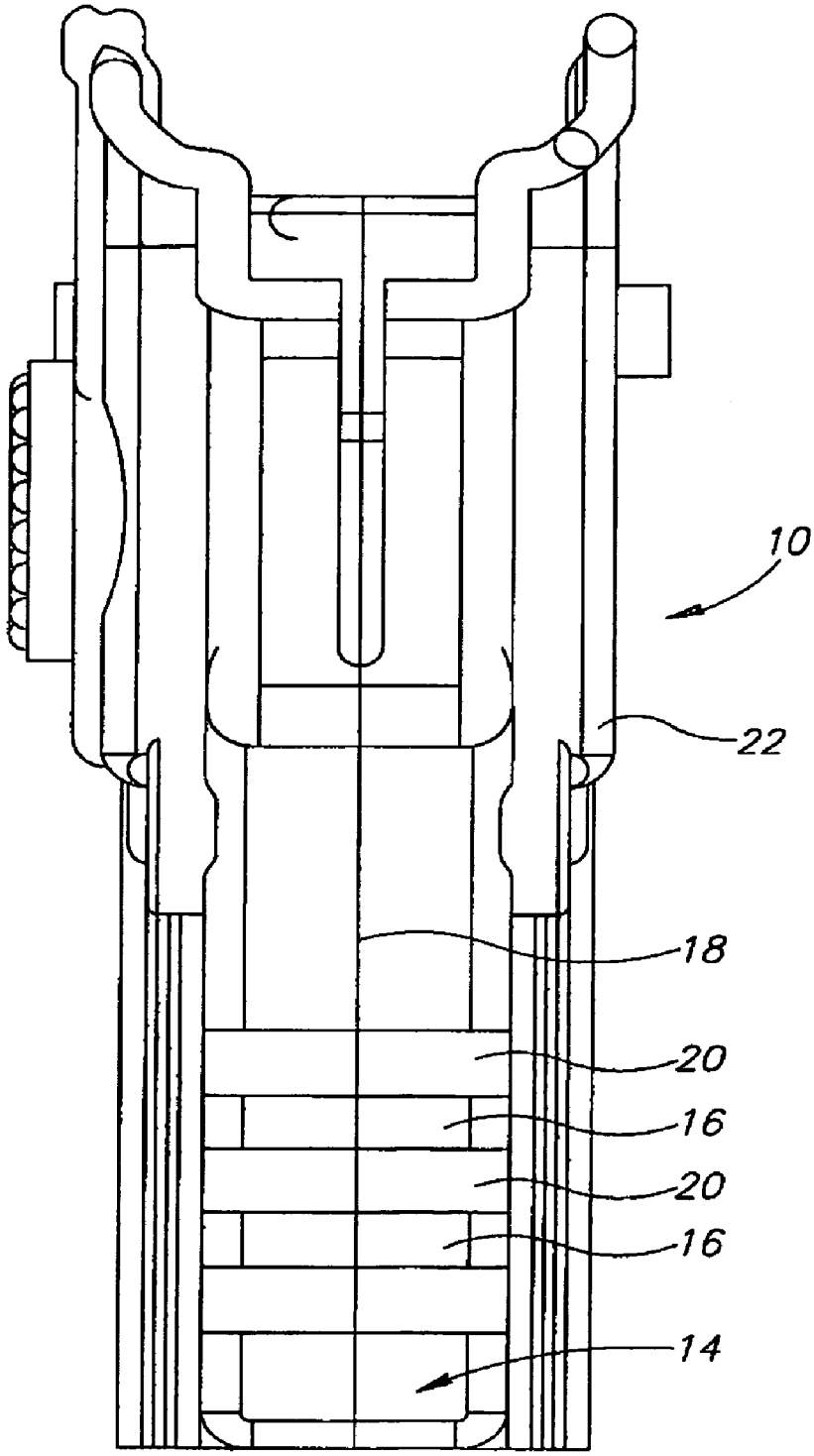

Reference is now made to FIGS. 1-2C, which illustrates a holster 10, constructed and operative in accordance with an embodiment of the present invention.

The holster 10 (or any other receptacle of the invention) may be constructed of any suitable material, such as but not limited to, natural or synthetic leather, plastics, carbon-fiber composites, and the like. For example, the holster 10 may be injection-molded as a one-piece construction. The holster 10 is shown in FIG. 1 with a weapon 12 disposed therein, e.g., a Springfield Armory model XD or any other handgun. However, the invention is not limited to handguns, and may be carried out with any kind of weapon, such as but not limited to, shoulder-fired weapons, shotguns and rifles (e.g., M1A, M16, AR15 & MP5's).

In accordance with an embodiment of the present invention, holster 10 has a light rail 14 affixed thereto. In the non-limiting illustrated embodiment, light rail 14 may have a plurality of ridges 16 spaced from one another along a rail axis 18. The ridges 16 may be separated by grooves 20 that are transverse to the rail axis 18. The light rail 14 may have any profile, such as but not limited to, a dovetail profile. The light rail 14 may be constructed in accordance with standardized light rails, such as but not limited to, the Picatinny mounting platform or any kind of universal mounting rail.

It is noted that the term "light rail" (or a "Picatinny rail", or "universal rail", or "tactical rail", or "accessories rail", the terms being used interchangeably throughout the specification and claims) as used in the description and the claims, encompasses any kind of mounting rail for accessories, not just lights. Examples of accessories are given hereinbelow.

Holster 10 may include a casing 22 with a volume 24 adapted for receiving the weapon 12 therein. The volume 24 may define a longitudinal axis 26. In the non-limiting illustrated embodiment, light rail 14 is generally parallel to longitudinal axis 26.

The light rail 14 may be positioned on a portion of casing 22 corresponding to a position of an underside 28 of a barrel 30 of weapon 12. Additionally or alternatively, the light rail 14 may be positioned corresponding to a topside 32 of barrel 30. However, the invention is not limited to these positions, and light rail 14 may be mounted on any other portion of holster 10.

Figure 3:
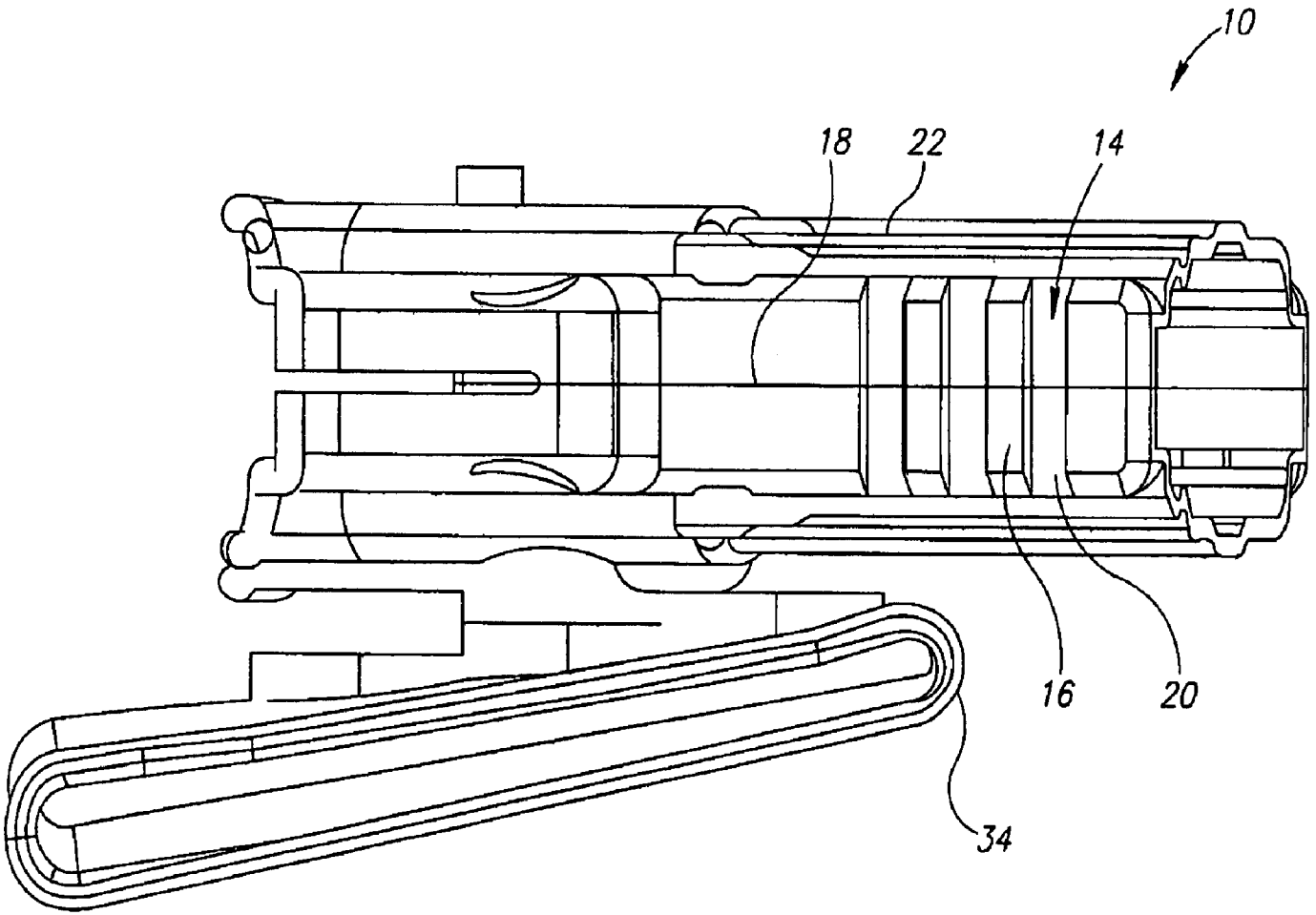
FIG. 3 is a simplified pictorial illustration of the holster of FIG. 1 with a belt-mounting device, in accordance with an embodiment of the present invention.
Figure 4:
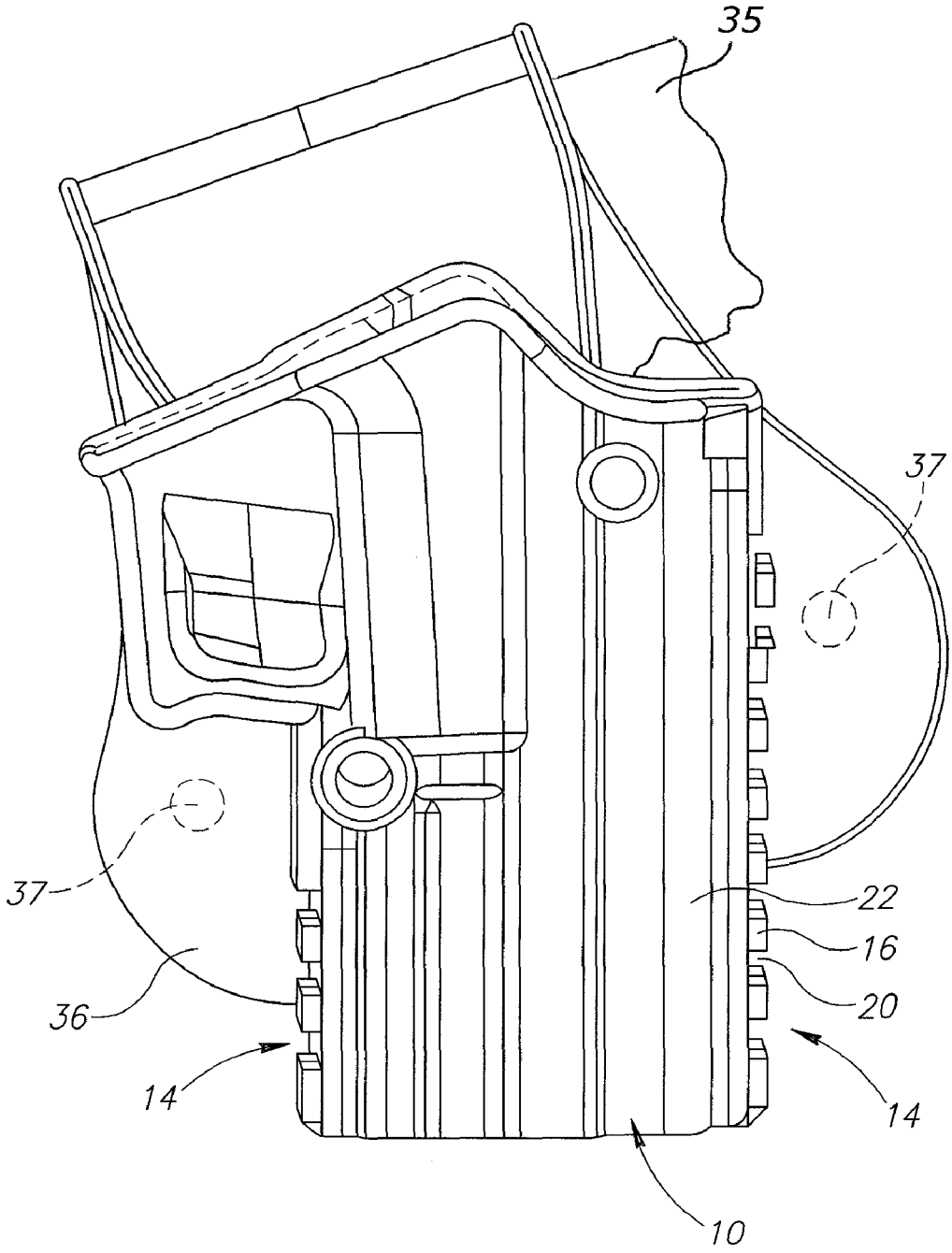
FIG. 4 is a simplified pictorial illustration of the holster of FIG. 1 with a paddle, in accordance with an embodiment of the present invention.

Reference is now made to FIG. 3, which illustrates holster 10 with a belt-mounting device 34, in accordance with an embodiment of the present invention. The belt-mounting device 34 may include, for example, a belt clip for clipping on to a belt, or a belt loop through which a belt may be slipped for a variety of belt widths Reference is now made to FIG. 4, which illustrates holster 10 with a paddle 36, in accordance with an embodiment of the present invention. As is well known in the art, paddle 36 may ride securely in a waistband 35 of a user. Paddle 36 may be provided with mounting studs 37 of different sizes and configurations, which permit adjusting the paddle 36 with respect to the holster 10 linearly (e.g., vertically and/or horizontally) and/or rotationally (e.g., in the plane of the paddle and/or out of the plane of the paddle).

As mentioned before, many kinds of accessories may be mounted on the light rail 14. The way in which the accessory attaches to the light rail 14 may be the same or similar to the way weapons lights (like those of SureFire and Insight Technology) attach to handguns, such as with spring-loaded lugs (not shown) that are held at the ridges 16 or grooves 20 of the light rail 14, as is well known in the art, and which does not require further description for the skilled artisan. FIG. 1 illustrates a non-coherent light device 38 mounted on the light rail 14, such as, but not necessarily, a SureFire weapon light, which is a two-battery, rail-mounted tactical light, with a grip-activated momentary switch and a constant-on shuttle switch.

Figure 5:
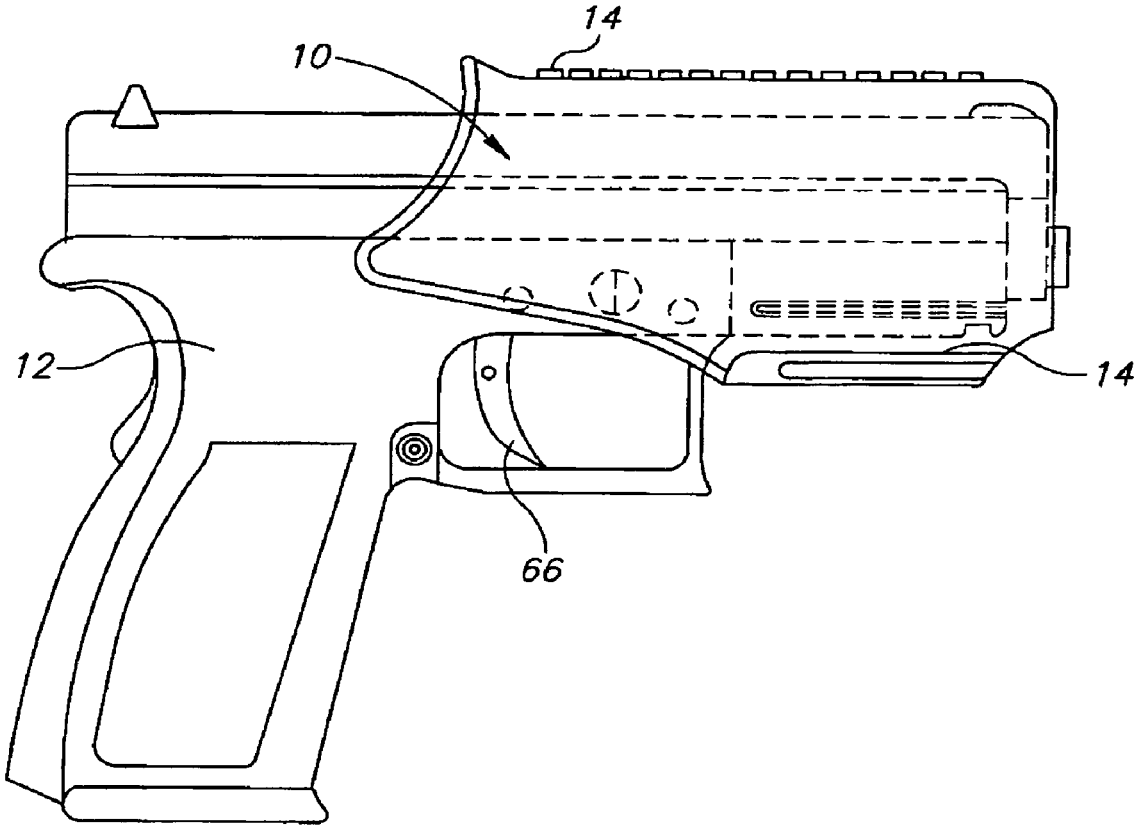
FIG. 5 is a simplified pictorial illustration of the holster of FIG. 1 configured as a mount (adapter), in accordance with an embodiment of the present invention.

Reference is now made to FIG. 5, which illustrates holster 10 configured as a mount/receptacle/container (adapter), in accordance with an embodiment of the present invention. In this embodiment, holster 10 is shaped so as not to block or interfere with a trigger 66 of weapon 12. In this manner, holster 10 may be used as a mount (adapter) for mounting lights or other accessories on weapon 12, even if weapon 12 itself is not equipped with light mounting rails.

Figure 6B:
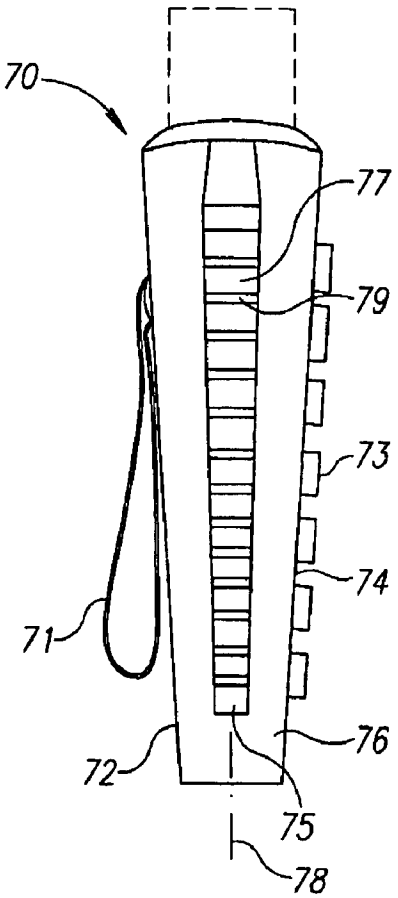
FIGS. 6A and 6B are simplified front and side view illustrations, respectively, of a tactical gear receptacle (here a magazine pouch) with a light rail, constructed and operative in accordance with an embodiment of the present invention.
Figure 6A:
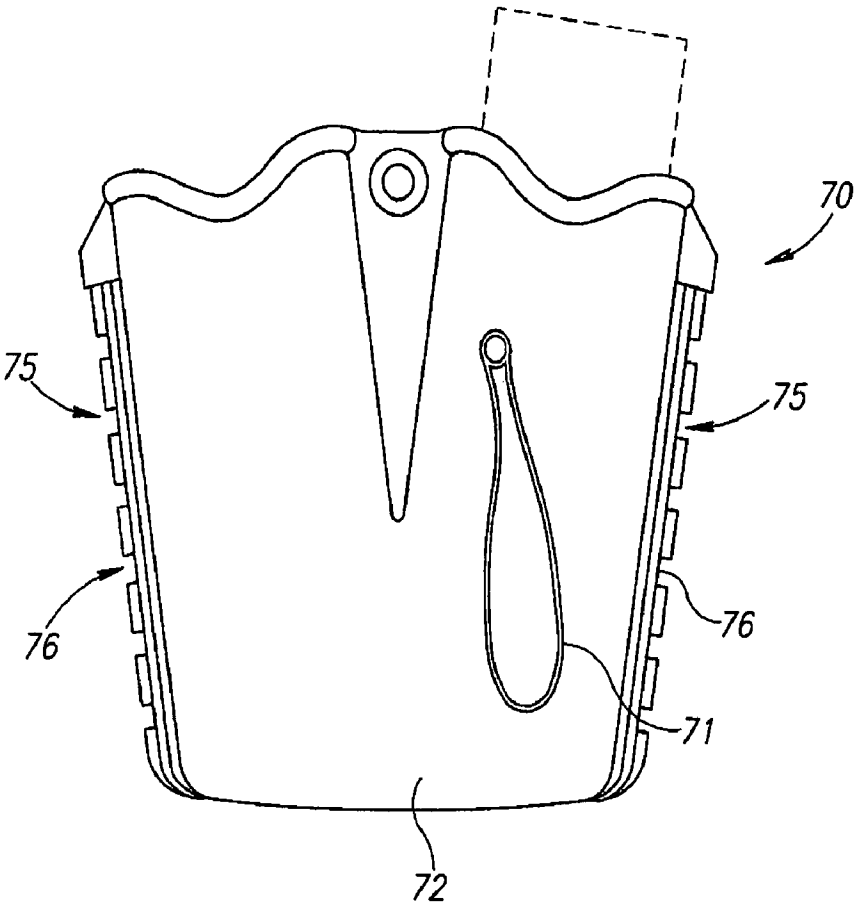

Reference is now made to FIGS. 6A and 6B, which illustrate a tactical gear receptacle 70, constructed and operative in accordance with an embodiment of the present invention.

Tactical gear receptacle 70 may include a carrying apparatus affixed on a first side thereof. For example, the carrying apparatus may be a carrying handle 71 attached to a side 72. Alternatively, the carrying apparatus may be a light rail 73 attached to a side 74. The carrying apparatus can support all or at least a part of the weight of the tactical gear receptacle 70 when the tactical gear receptacle 70 is carried. (It is noted that the holsters described hereinabove also have carrying apparatus, e.g., belt-mounting device 34 or paddle 36.)

Figure 7A:
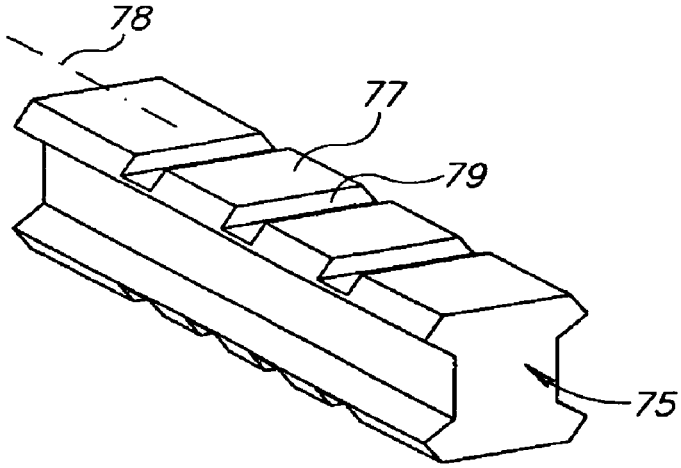
FIGS. 7A, 7B and 7C are simplified pictorial illustrations of different combinations of male and female light rails that may be used with the embodiments of the present invention.
Figure 7B:
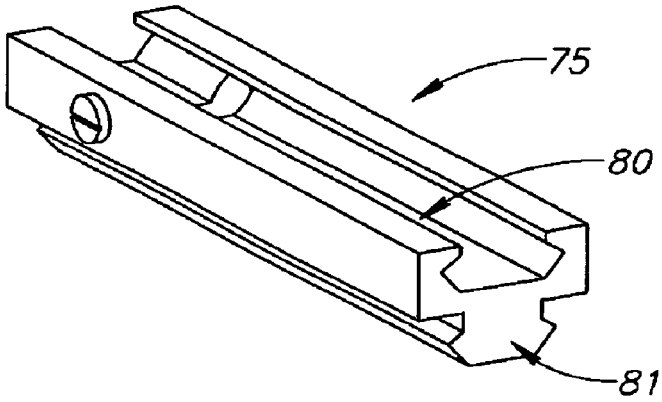
Figure 7C:
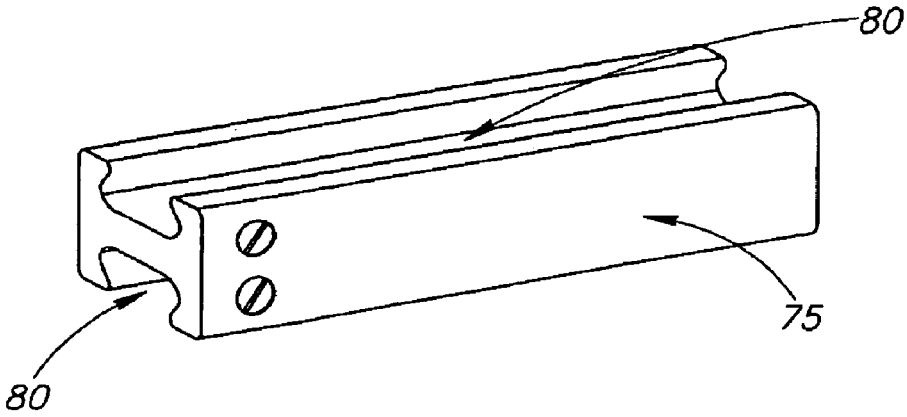

A light rail 75 is affixed to a second side 76 of the tactical gear receptacle 70, different from the first side (side 72 or 74, in the illustration). As with the holsters described hereinabove, the light rail may be male or female or a combination of both. For example, as seen in FIGS. 6B and 7A, light rail 75 may include a plurality of ridges 77 spaced from one another along a rail axis 78, ridges 77 being separated by grooves 79 that are transverse to the rail axis 78. In FIG. 7B, light rail 75 includes a mortise (female connector) 80 and a tenon (male connector) 81. The mortise 80 is adapted for receiving therein a tenon or similar projection from a tactical gear item (e.g., a light). Similarly, tenon 81 may be inserted into a mortise or similar channel or groove found in a tactical gear item (e.g., a light). In FIG. 7C, light rail 75 includes a pair of mortises (female connectors) 80. Any combination of connectors is within the scope of the invention.

A first tactical gear item 82 (e.g., a magazine, shown in broken lines in FIGS. 6A and 6B) may be disposed in the tactical gear receptacle 70 and a second tactical gear item 83 (e.g., a light, shown in broken lines in FIG. 6A) may be mounted on the light rail 75 of the tactical gear receptacle

70. In this case, the second tactical gear item 83 (e.g., light) is not mountable on the first tactical gear item 82 (e.g., magazine).

This is in contrast with the holsters described hereinabove, wherein a first tactical gear item (e.g., weapon 12) may be disposed in the tactical gear receptacle (e.g., holster 10) and a second tactical gear item (e.g., light 38) may be mounted on the light rail of the tactical gear receptacle (e.g., holster 10), wherein the second tactical gear item can be mounted on the light rail of the first tactical gear item.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. Apparatus comprising:

a tactical gear receptacle comprising a carrying apparatus affixed on a first side thereof, said carrying apparatus comprising a garment fastening device, said tactical gear receptacle being fastened to a garment of a user with said garment fastening device, said carrying apparatus being adapted to support at least a partial weight of said tactical gear receptacle when said tactical gear receptacle is carried; and a rail affixed to a second side of said tactical gear receptacle on an external portion of said tactical gear receptacle, wherein said rail comprises a plurality of ridges spaced from one another along a rail axis, the ridges being separated by grooves that are transverse to the rail axis.

2. The apparatus according to claim 1, wherein said rail comprises a tenon for receiving therein a mortise.

3. The apparatus according to claim 1, further comprising a first tactical gear item disposed in said tactical gear receptacle and a second tactical gear item mounted on the rail of the tactical gear receptacle, wherein the second tactical gear item is mountable on a rail of the first tactical gear item.

4. The apparatus according to claim 1, further comprising a first tactical gear item disposed in said tactical gear receptacle and a second tactical gear item mounted on the rail of the tactical gear receptacle, wherein the second tactical gear item is not mountable on the first tactical gear item.

5. The apparatus according to claim 1, wherein said carrying apparatus comprises a belt-mounting device.

6. The apparatus according to claim 1, wherein said carrying apparatus comprises a paddle.

7. The apparatus according to claim 1, wherein said carrying apparatus comprises another rail.

8. The apparatus according to claim 1, wherein said carrying apparatus comprises a carrying handle.

9. The apparatus according to claim 1, wherein said tactical gear receptacle comprises a holster.

10. The apparatus according to claim 1, wherein said tactical gear receptacle comprises a magazine pouch.

11. A method comprising:

providing a tactical gear receptacle comprising a carrying apparatus affixed on a first side thereof, said carrying apparatus comprising a garment fastening device and being adapted to support at least a partial weight of said tactical gear receptacle when said tactical gear receptacle is carried, and wherein a rail is affixed to a second side of said tactical gear receptacle on an external portion of said tactical gear receptacle, wherein said rail comprises a plurality of ridges spaced from one another along a rail axis, the ridges being separated by grooves that are transverse to the rail axis; and fastening said tactical gear receptacle to a garment of a user with said garment fastening device.

* * * * *